US005715574A

United States Patent [19]

Schall

[11] Patent Number: 5,715,574

[45] Date of Patent: Feb. 10, 1998

[54] ADJUSTABLE SELF-CLOSING HINGE ASSEMBLY

[75] Inventor: Frederick R. Schall, Mt. Laurel, N.J.

[73] Assignee: Delair Group LLC, N.J.

[21] Appl. No.: 617,420

[22] Filed: Mar. 18, 1996

[51] Int. Cl.[6] ..... E05F 1/08

[52] U.S. Cl. ..... 16/301; 16/50

[58] Field of Search ..... 16/301, 365, 304, 16/71, 72, 76, 293, 295, 285, 378, 50, 298

[56] References Cited

U.S. PATENT DOCUMENTS

| | | | |
|---|---|---|---|
| 29,212 | 6/1860 | Acker | 16/298 |
| 3,978,551 | 9/1976 | Mochizuki | 16/50 |
| 4,073,038 | 2/1978 | Curry et al. | 16/301 |
| 4,817,242 | 4/1989 | Rapp | 16/301 |
| 5,572,768 | 11/1996 | Daul | 16/50 |
| 5,584,100 | 12/1996 | Doyle | 16/301 |

*Primary Examiner*—Chuck Mah
*Assistant Examiner*—Mark Williams
*Attorney, Agent, or Firm*—Jay M. Cantor

[57] ABSTRACT

A method of adjusting an adjustable self closing hinge and the hinge which comprises providing an adjustable, self closing hinge. The hinge includes a tube with a hollow interior portion of circular cross section, a first end portion and a second end portion. A spring is disposed in the tube along its axis and has a spring end extending toward the first end portion and a second secured spring end extending toward the second end portion. A depression is provided at the first end portion of the tube extending into the hollow portion and a rotatable member is disposed within the hollow portion at the first end portion thereof and rotatable therein for adjusting the torque of the spring. The rotatable member is secured to the first spring end and has a flat wall portion at the end portion of the rotatable member opposing the spring and parallel to the axis, the wall and the rotatable member together forming a seat in the rotatable member. The depression is normally disposed against the seat and opposes the wall to prevent movement of the rotatable member out of the tube and rotation of the tubular member within the tube. A force is applied to the rotatable member along the axis to depress the rotatable member into the hollow interior portion until the wall is no longer disposed opposing the depression and is beneath the depression. The rotatable member is than rotated until a seat is again disposed directly over the depression and the force is than removed from the rotatable member so that the depression again rests on the seat and opposed to the side wall.

20 Claims, 3 Drawing Sheets

ADJUSTABLE SELF-CLOSING HINGE ASSEMBLY

BACKGROUND OF THE INVENTION

1 Field of the Invention

This invention relates to a hinge assembly and, more specifically, to an adjustable, self closing hinge assembly.

2 Brief Description of the Prior Art

Self closing hinges, particularly such hinges used in outdoor environments, have generally not been very durable. Such hinges are constantly subjected to exterior weather conditions which attack the self closing mechanism. In those cases where the self closing mechanism is protected from the exterior environment, it becomes increasingly difficult to adjust the torque of the self closing mechanism spring. It is therefore apparent that an adjustable, self closing hinge capable of overcoming the above described problems is highly desirable.

SUMMARY OF THE INVENTION

In accordance with the present invention, there is provided an adjustable, self closing hinge which is very durable and whose spring torque can be easily adjusted with a screwdriver or the like.

Briefly, there is provided a hinge having a plurality of leaves, preferably but not limited to three leaves, all of the leaves having a common axis of rotation. Each leaf has one or more hollow circular portions through which the axis of rotation passes, these hollow portions being disposed on each of the leaves so that none of the hollow circular portions overlap each other and collectively form a hollow tubular member when the leaves are assembled together. The hollow circular portions preferably extend out from an edge of the associated leaf. At least one dimple or depressions is disposed at one or both extreme ends of the hollow tubular member and extends into the hollow region.

Disposed within the hollow tubular structure is a spiral wound spring assembly, preferably of stainless steel, which includes a spring having an end portion at one or both ends thereof extending in a direction along the axis of rotation. A cylindrically shaped cam having a diameter slightly less than that of the hollow tubular member hollow portion is provided which has a first hole at one end extending partially therethrough along the major axis of the cylinder and a second hole at the same end for receiving an end portion of the spring. One such cam can be provided at each end of the spring or, alternatively, one such cam can be provided at one end of the spring with the other end of the spring secured in some manner against rotation.

A pin passes through the central portion of the spring and extends into the first hole in each of the cams to align the cams with each other and with the axis of rotation of the hinge. If only one cam is used, provision is made at the non-cam containing end of the spring to receive an end of the pin along the axis of rotation of the hinge. The cams include a screwdriver slot or the like at their end surface opposing the end surface containing the first and second holes for rotation of the cams. A part of the opposing end portion of the cam extending to the opposing end surface has a cross section normal to the axis of the hollow member having at least one flat side wall portion and a seat on the cam at the inwardmost portion of the flat side wall. Preferably, this part of the cam is rectangular in shape with the largest diagonal dimension being equal to the radius of the cam. Another possible configuration for this end portion is that of a truncated disk which is a disk with a flat sidewall portion. The dimple or depression is designed to extend into the portion of the cam that has been removed to form the flat side wall portion to prevent rotation of the cam and the spring therewith and against the seat to prevent movement of the cam out of the hollow tubular member. To tighten or loosen the spring, a screwdriver or other appropriate tool is placed in the slot and pushed inwardly so that the opposing surface of the cam is disposed within the hollow tubular member and beneath the dimple or depression. The tool is then turned in a clockwise or counter-clockwise direction to tighten or loosen the spring and the tool is then released with the dimple or depression disposed at the location of a flat side wall portion and finally resting against the seat at the base of the flat side wall portion. This permits the cam to return to its original position with the dimple or depression positioned along the flat side wall to prevent further rotation of the cam.

DESCRIPTION OF THE PREFERRED EMBODIMENT

Figure 1:
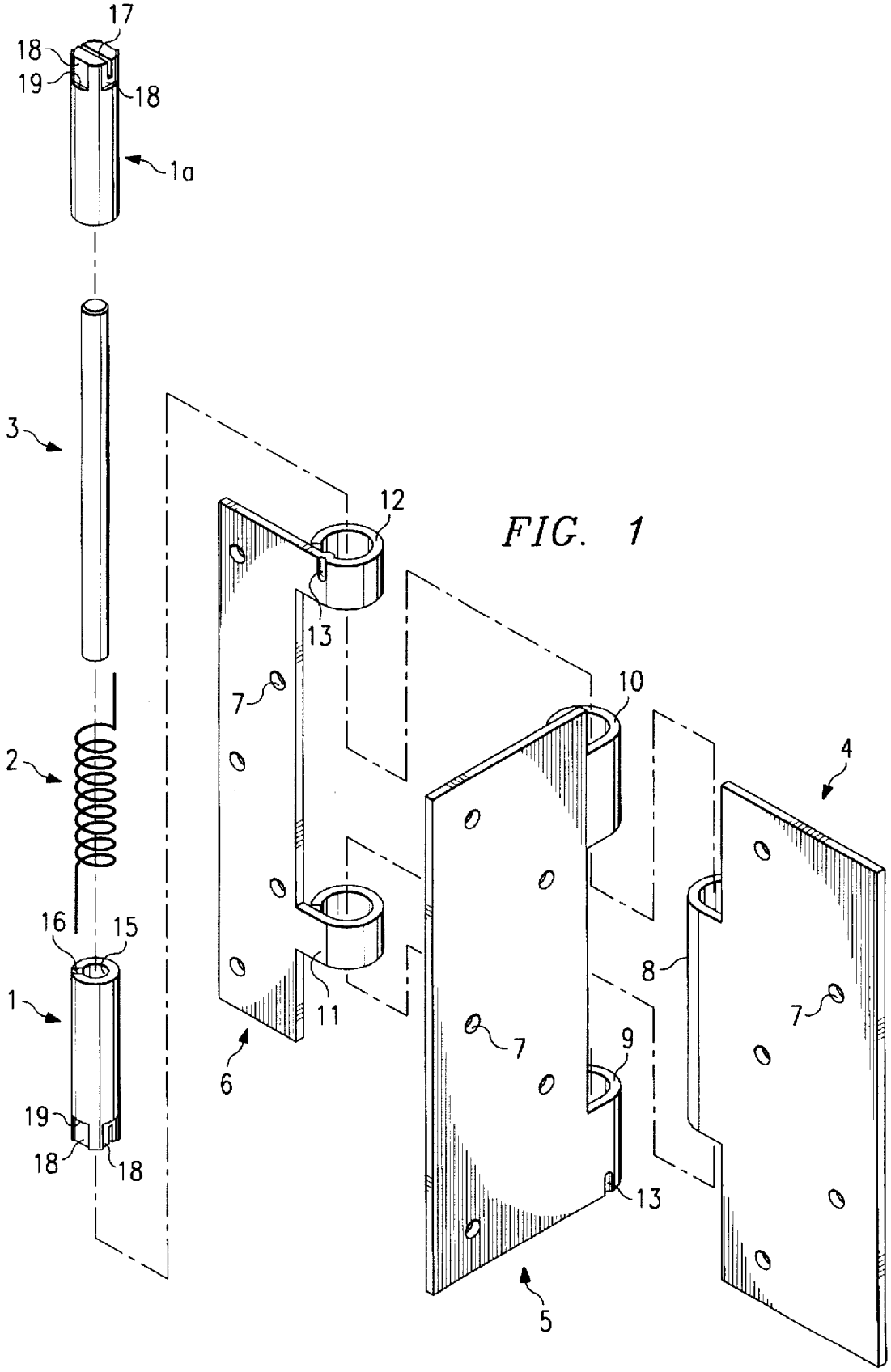
FIG. 1 is an exploded view of a hinge in accordance with the present invention.

Referring to FIG. 1, there are shown three hinge leaves 4, 5 and 6. Each of the hinge leaves includes a flat portion having screw receiving holes 7 therein. The leaves 4 and 5 are generally secured via screws through the screw receiving holes 7 to adjacent surfaces of a post, wall member or the like and the leaf 6 is generally secured to a door, gate or the like in standard manner. The leaf 4 has a centrally located hollow circular portion 8 at an edge thereof, the leaf 5 has a pair of hollow circular portions 9 and 10 at an edge thereof, with hollow portion 9 extending to the left edge of the leaf 5 and the hollow portion 10 being spaced therefrom and the leaf 6 has a pair of hollow circular portions 11 and 12 at an edge thereof, the hollow portion 12 extending to the right edge of the leaf 6 and the hollow portion 11 being spaced therefrom. The leaves 4, 5 and 6 are positioned relative to each other in assembled state so that hollow portions 8 to 12 form a tubular or hollow circular structure with the axes of hollow circular portion 8 of leaf 4, hollow circular portions 9 and 10 of leaf 5 and hollow circular portions 11 and 12 of leaf 6 all coaxial as shown in FIG. 3. The hollow interiors of the hollow circular portions are also circular. The extreme outer portions of hollow circular portions 9 and 12 each have a dimple 13 as shown in FIGS. 1, 4, 5*a* and 5*b* to retain the cams 1 and 1*a* of the cam and spring assembly shown in FIGS. 1 and 2 within the hollow section formed by hollow circular portions 8 through 12 as shown in FIG. 3 and to prevent the cams from rotating as will be explained in detail hereinbelow.

Figure 2:
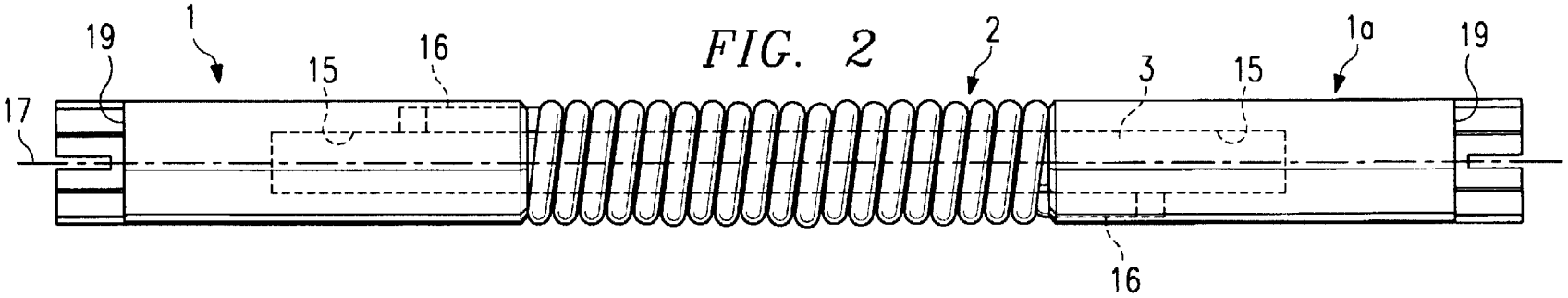
FIG. 2 is a side view of the cam and spring assembly in accordance with the present invention.
Figure 3:
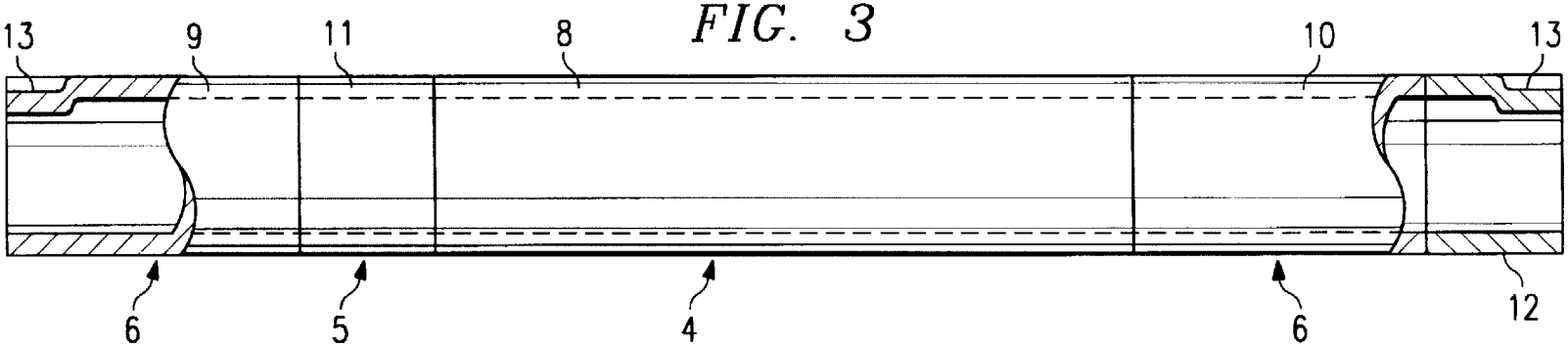
FIG. 3 is a side view of the hollow circular portions of the hinge elements in assembled condition.
Figure 4:
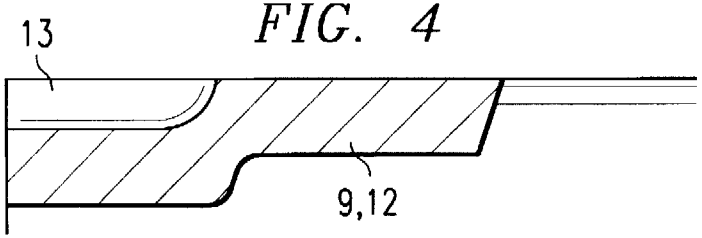
FIG. 4 is an enlarged view of the end portion of the extreme hollow circular portions in accordance with the present invention.
Figure 5A:
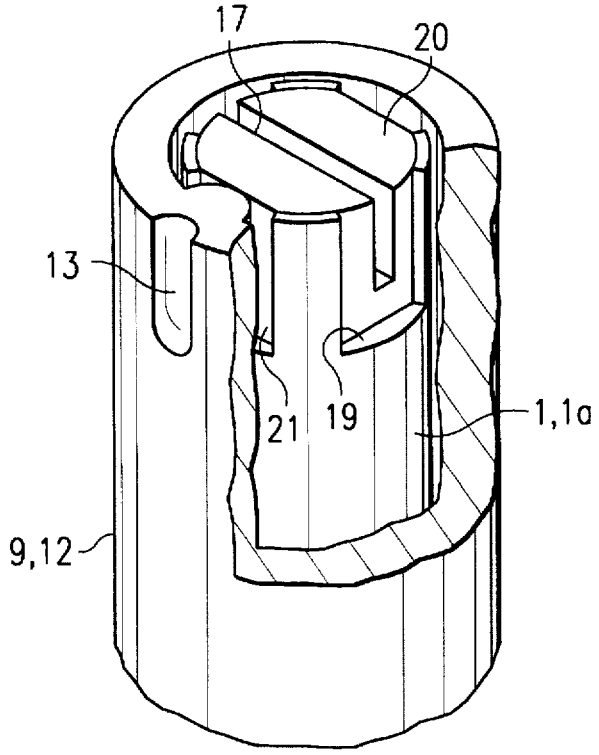
FIG. 5*a* is an enlarged perspective view of a cam 1 or 1*a* disposed in a hollow circular portion 9 or 12 of the assembled hinge in the relaxed, non rotatable position.
Figure 5B:
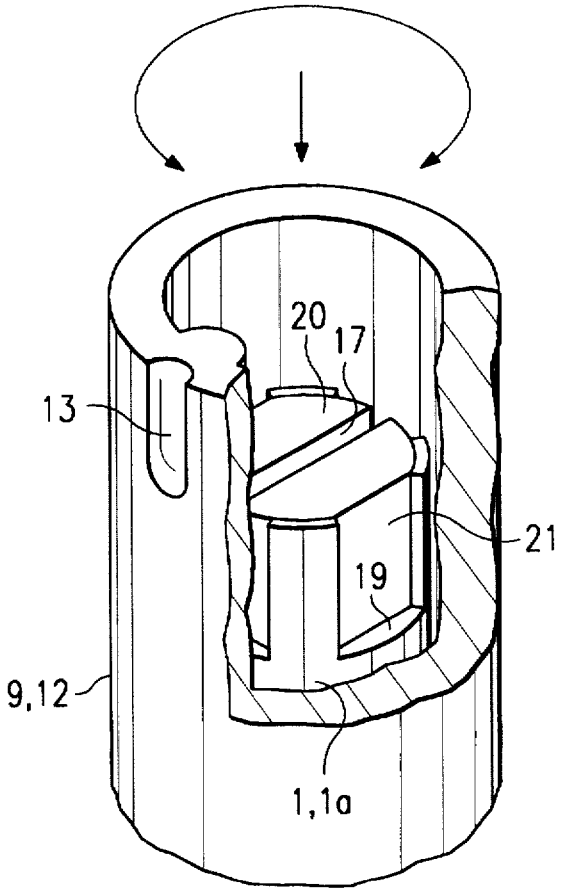
FIG. 5*b* is a view as in FIG. 5*a* with the cam in the depressed, rotatable position.

Referring again to the FIGURES, there is shown in FIGS. 1, and 2 the cam and spring assembly in accordance with the preferred embodiment. The cam and spring assembly is disposed within the hollow circular portions 8 through 12 which form the hollow tubular member as described above. This assembly includes a pair of identical cams 1 and 1*a* of circular cross section except for their end portions which are designed to fit within the hollow section formed by hollow circular portions 8 through 12. Each of the cams 1, 1*a* has a first hole or bore 15 extending along the axis thereof and partially therethrough for receiving a pin 3 and a second hole 16 parallel to and spaced from the bore 15 for receiving an end of the spring 2. The pin 3 extends within and along the axis of the spring 2 and is provided to properly align the cams 1, 1*a* and the spring. The cams 1, 1*a* each have a rectangular portion 20 with side walls 21 wherein the largest dimension across a cross section therethrough normal to the axis of the tubular portion is no greater than the diameter of the cam and preferably equal to the diameter of the cam. Seats 19 are provided at the base of each side wall 21 on the circular portions of the cams 1, 1*a* and adjacent the rectangular portion as best shown in FIGS. 5*a* and 5*b*. The rectangular portion also include at the extreme ends thereof a groove 17 for receiving a tool for turning, such as a screwdriver.

In operation, the leaves 4, 5 and 6 are positioned relative to each other as shown in FIG. 3 with the dimples 13 already formed at one end. The cam assembly as shown in FIG. 2 is then inserted into the hollow section formed by hollow circular portions 8 through 12 via the undimpled end and the dimple 13 is then pressed into the undimpled end. This causes the cam assembly to be retained within the hollow section with a seat 19 of one of the flat portion riding against the dimple 13. The spring 2 is tightened or loosened by placing a screwdriver in the groove 17 and depressing the cam 1 or 1*a* inwardly to clear the dimple 13 as shown in FIG. 5*b* and then rotating the cam in one direction for tightening and in the opposite direction for loosening. The cam is then permitted to return to its initial position as shown in FIG. 5*a* by aligning the dimple 13 with a seat 19 whereby the dimple 13 prevents the cam from rotating and the seat prevents the cam from exiting the hollow tubular member.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

I claim:

1. An adjustable, self closing hinge which comprises:

(a) a hollow tubular member having a hollow interior portion with a circular cross section, a hollow tubular member axis normal to said circular cross section, a first end portion and a second end portion;

(b) a spring having a spring axis, said spring axis disposed in said hollow tubular member along said hollow tubular member axis and having a first spring end extending toward said first end portion and a second secured spring end extending toward said second end portion;

(c) a depression at said first end portion of said hollow tubular member extending into said hollow interior portion; and (d) a rotatable cylindrical member disposed within said hollow interior portion at said first end portion thereof and rotatable therein for adjusting the torque of said spring, said rotatable member being secured to said first spring end and having a plurality of spaced apart flat wall portions at the end portion of said rotatable member opposed to said spring and parallel to each said axis, said plurality of spaced apart flat wall portions forming seat for said depression in said rotatable member;

(e) said depression normally disposed against one of said plurality of spaced apart flat wall portions to prevent movement of said rotatable member out of said hollow tubular member and rotation of said tubular member within said hollow tubular member.

2. The hinge of claim 1 further including a plurality of leaves, each of said leaves having at least one hollow tubular portion extending from an edge thereof, said hollow tubular portions of said leaves being disposed relative to each other to form said hollow tubular member.

3. The hinge of claim 2 wherein said rotatable member is a cylindrical member having a pair of opposing flat surfaces, one of said flat surfaces including a first hole therein receiving said first spring end and the opposing flat surface having a tool-receiving groove.

4. The hinge of claim 3 wherein the end portion of said cylindrical member containing said tool-receiving groove includes said plurality of flat wall portions and said seats.

5. The hinge of claim 4 wherein said one of said surfaces includes a second hole extending partially therethrough and disposed along the axis of said rotatable member and a pin extending along the axis of said spring, secured at one end thereof and disposed at its other end within said second hole.

6. The hinge of claim 5 wherein said cam includes at the portion thereof opposing said one of said surfaces a rectangular parallelepiped portion having a diagonal substantially equal to the diameter of said cam, the side walls of said parallelepiped providing said plurality of flat wall portions of said rotatable member.

7. The hinge of claim 4 wherein said cam includes at the portion thereof opposing said one of said surfaces a rectangular parallelepiped portion having a diagonal substantially equal to the diameter of said cam, the side walls of said parallelepiped providing said plurality of flat wall portions of said rotatable member.

8. The hinge of claim 7 wherein said one of said surfaces includes a second hole extending partially therethrough and disposed along the axis of said rotatable member and a pin extending along the axis of said spring, secured at one end thereof and disposed at its other end within said second hole.

9. The hinge of claim 3 wherein said one of said surfaces includes a second hole extending partially therethrough and disposed along the axis of said rotatable member and a pin extending along the axis of said spring, secured at one end thereof and disposed at its other end within said second hole.

10. The hinge of claim 9 wherein said cam includes at the portion thereof opposing said one of said surfaces a rectangular parallelepiped portion having a diagonal substantially equal to the diameter of said cam, the side walls of said parallelepiped providing said plurality of flat wall portions of said rotatable member.

11. The hinge of claim 3 wherein said cam includes at the portion thereof opposing said one of said surfaces a rectangular parallelepiped portion having a diagonal substantially equal to the diameter of said cam, the side walls of said parallelepiped providing said plurality of flat wall portions of said rotatable member.

12. The hinge of claim 1 wherein said rotatable member is a cylindrical cam having a pair of opposing flat surfaces, one of said flat surfaces including a first hole therein receiving said first spring end and the opposing flat surface having a tool-receiving groove.

13. The hinge of claim 12 wherein the end portion of said cylindrical member containing said tool-receiving groove includes said plurality of flat wall portions and said seats.

14. The hinge of claim 13 wherein said one of said surfaces includes a second hole extending partially therethrough and disposed along the axis of said rotatable member and a pin extending along the axis of said spring, secured at one end thereof and disposed at its other end within said second hole.

15. The hinge of claim 1 further including a second depression at said second end portion of said hollow tubular member extending into said hollow portion and a second rotatable member disposed within said hollow interior portion at said second end portion thereof and rotatable therein for adjusting the torque of said spring, said second rotatable member being secured to said second spring end and having a second plurality of flat wall portions at the end portion of said second rotatable member opposed to said spring and parallel to each said axis, said second plurality of flat wall portions forming a second seat for said depression in said second rotatable member, said second depression normally disposed against one of said plurality of second flat wall portions to prevent movement of said rotatable member out of said hollow tubular member and rotation of said tubular member within said hollow tubular member.

16. The hinge of claim 15 wherein said second rotatable member is a second cylindrical cam having a pair of opposing flat surfaces, one of said flat surfaces including a third hole therein receiving said second spring end and the opposing flat surface having a tool-receiving groove.

17. The hinge of claim 16 wherein the end portion of said second cylindrical member containing said tool-receiving groove includes said second plurality of flat wall portions and said second seats.

18. The hinge of claim 16 wherein said one of said surfaces includes a fourth hole extending partially therethrough and disposed along the axis of said second rotatable member, said pin extending along the axis of said spring and disposed at its one end within said fourth hole.

19. A method of adjusting an adjustable self closing hinge comprising the steps of:

(a) providing an adjustable, self closing hinge having a hollow tubular member with a hollow interior portion of circular cross section, a hollow tubular member axis normal to said circular cross section, a first end portion and a second end portion, a spring having a spring axis, said spring axis disposed in said hollow tubular member along said axis and having a first spring end extending toward said first end portion and a second secured spring end extending toward said second end portion, a depression at said first end portion of said hollow tubular member extending into said hollow interior portion; and a rotatable member disposed within said hollow interior portion at said first end portion thereof and rotatable therein for adjusting the torque of said spring, said rotatable member being secured to said first spring end and having a plurality of spaced apart flat wall portions at the end portion of said rotatable member opposing said spring and parallel to each said axis, said plurality of flat wall portions forming seats for said depression in said rotatable member, said depression normally disposed against one of said plurality of flat wall portions to prevent movement of said rotatable member out of said hollow tubular member and rotation of said tubular member within said hollow tubular member;

(b) applying a force to said rotatable member along said axis to depress said rotatable member into said hollow interior portion until a said flat wall portion is no longer disposed opposing said depression and is beneath said depression;

(c) rotating said rotatable member until a different said seat is again disposed directly beneath said depression; and (d) removing said force from said rotatable member to permit said rotatable member to move along said axis in an opposite direction until said depression contacts said different seat.

20. An adjustable, self closing hinge which comprises:

(a) a hollow tubular member having a hollow interior portion with a circular cross section, a hollow tubular member axis normal to said circular cross section, a first end portion and a second end portion;

(b) a spring having a spring axis, said spring axis disposed in said hollow tubular member along said hollow tubular member axis and having a first spring end extending toward said first end portion and a second secured spring end extending toward said second end portion;

(c) a depression at said first end portion of said hollow tubular member extending into said hollow interior portion; and (d) a rotatable cylindrical member disposed within said hollow interior portion at said first end portion thereof and rotatable therein for adjusting the torque of said spring, said rotatable member being secured to said first spring end and having a plurality of spaced apart flat wall portions extending for only a portion of the axial length of said cylindrical member and disposed at the end portion of said rotatable member opposed to said spring, the plane of said wall portions being parallel to each said axis, said plurality of spaced apart flat wall portions forming seats for said depression in said rotatable member;

(e) said depression normally disposed against one of said plurality of spaced apart flat wall portions to prevent movement of said rotatable member out of said hollow tubular member and rotation of said tubular member within said hollow tubular member.

* * * * *